US011364406B2

(12) United States Patent
Ellis

(10) Patent No.: US 11,364,406 B2
(45) **Date of Patent: *Jun. 21, 2022**

(54) DUMBBELL SAFETY, DEFENSIVE AND ALERTING ASSEMBLY

(71) Applicant: Andrew Ellis, Chesterfield, MO (US)

(72) Inventor: Andrew Ellis, Chesterfield, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/062,808

(22) Filed: Oct. 5, 2020

(65) Prior Publication Data

US 2021/0016125 A1 Jan. 21, 2021

Related U.S. Application Data

(63) Continuation of application No. 16/376,807, filed on Apr. 5, 2019, now Pat. No. 10,821,317.

(51) Int. Cl.

| | |
|---|---|
| ***A63B 21/072*** | (2006.01) |
| ***A63B 23/16*** | (2006.01) |
| ***A63B 21/045*** | (2006.01) |
| ***G08B 21/02*** | (2006.01) |
| ***F41H 13/00*** | (2006.01) |
| ***F41H 9/10*** | (2006.01) |
| ***G08B 15/00*** | (2006.01) |

(52) U.S. Cl.

CPC ..... *A63B 21/0724* (2013.01); *A63B 21/0455* (2013.01); *A63B 23/16* (2013.01); *F41H 9/10* (2013.01); *F41H 13/0012* (2013.01); *G08B 15/005* (2013.01); *G08B 21/02* (2013.01); *A63B 2225/74* (2020.08)

(58) Field of Classification Search

CPC ..... A63B 21/0455; A63B 21/072–075; A63B 23/16; A63B 2225/74; F41H 9/10; F41H 13/0012; G08B 15/005; G08B 21/02

See application file for complete search history.

(56) References Cited

U.S. PATENT DOCUMENTS

| | | | | |
|---|---|---|---|---|
| 965,284 | A | 7/1910 | Dossetter | |
| 1,026,215 | A | 5/1912 | Korth | |
| 3,638,836 | A | 2/1972 | Vickers | |
| 4,021,040 | A | 5/1977 | Inoue | |
| 4,905,988 | A | 3/1990 | Mooneyhan | |
| 5,033,740 | A | 7/1991 | Schwartz et al. | |
| 5,086,377 | A | 2/1992 | Roberts | |
| 5,087,032 | A | 2/1992 | Gresh | |
| 5,135,454 | A | 8/1992 | Yeh | |
| 5,242,349 | A | 9/1993 | Reiff et al. | |
| 5,266,927 | A * | 11/1993 | Sanders | G08B 15/004 340/574 |
| 5,286,244 | A * | 2/1994 | Wright | A63B 21/0726 116/202 |
| 5,318,492 | A | 6/1994 | Quinn | |
| 5,325,997 | A | 7/1994 | Washington et al. | |

(Continued)

*Primary Examiner* — Jennifer Robertson

(74) *Attorney, Agent, or Firm* — Greensfelder, Hemker & Gale PC; Jared S. Manse

(57) ABSTRACT

An exercise device having a bar with a first handle, a grip exerciser having a second handle connected to the bar via a resistance member proximate the first handle and moveable between a first position and a second position by a hand of a user; and an auxiliary device connected to the bar selected from a light assembly, a sound generator, an electrified defensive unit, a pressurized defensive unit, and combinations of the same.

20 Claims, 7 Drawing Sheets

(56) References Cited

U.S. PATENT DOCUMENTS

| | | | | |
|---|---|---|---|---|
| 5,332,119 | A | 7/1994 | Davis | |
| 5,428,514 | A | 6/1995 | Fink, Jr. | |
| 5,476,192 | A | 12/1995 | Julinot | |
| 5,518,478 | A | 5/1996 | Liang | |
| 5,549,220 | A | 8/1996 | Whalen | |
| 5,556,003 | A | 9/1996 | Johnson et al. | |
| 5,575,555 | A | 11/1996 | Chang | |
| 5,683,168 | A | 11/1997 | Teig et al. | |
| 5,709,635 | A | 1/1998 | Denison | |
| 5,795,054 | A | 8/1998 | Booty, Jr. | |
| 5,873,783 | A | 2/1999 | McBain et al. | |
| 5,941,629 | A | 8/1999 | Tuscher | |
| 6,132,345 | A | 10/2000 | Beierschmitt et al. | |
| 7,509,955 | B2 | 3/2009 | Cole et al. | |
| 9,550,087 | B2 | 1/2017 | Tansil | |
| 10,821,317 | B2 * | 11/2020 | Ellis | F41H 9/10 |
| 2015/0165270 | A1 * | 6/2015 | Allos | A63B 69/0028 482/8 |
| 2017/0072247 | A1 | 3/2017 | Wilson | |
| 2017/0361159 | A1 | 12/2017 | Malcolm | |
| 2018/0264310 | A1 | 9/2018 | Curole et al. | |
| 2019/0329096 | A1 | 10/2019 | Lohne et al. | |

* cited by examiner

DUMBBELL SAFETY, DEFENSIVE AND ALERTING ASSEMBLY

CROSS-REFERENCE TO RELATED APPLICATIONS

The present invention is a continuation of U.S. patent application Ser. No. 16/376,807 filed Apr. 5, 2019, the contents of which are incorporated herein by reference and made a part hereof.

FEDERALLY SPONSORED RESEARCH OR DEVELOPMENT

N/A

FIELD OF THE INVENTION

The present invention provides a dumbbell and grip exerciser with built in safety features such as a light assembly, an alarm generator, an electrified defensive device and/or a pressurized defensive device.

BACKGROUND OF THE INVENTION

Walking, running and weight lifting are common modes of exercise. Many people choose to enhance their walking or running workouts by adding weights to the workout. Ankle weights, weighted vests and jackets are commonly used by exercisers to enhance their workouts. Exercisers also commonly carry a dumbbell or a pair of dumbbells and do arm curls and other exercises while walking or running. Walking and running can present a risk of injury or death, especially when done outdoors, from numerous sources such as wheeled vehicles, tripping hazards, electrical hazards, water hazards, and threats from animals and humans, to name a few. Thus, there is a need to incorporate safety devices into a piece of exercise equipment to make exercise safer. A flashlight can help illuminate the pathway, and make the exerciser more visible to passing traffic and people. A sound generator can be used by an exerciser to signal a very loud alarm to summons help and to scare off attackers or potential attackers. An electrified defense (or defensive) unit (or device) with electrodes, e.g., stun gun, TASER, can be used in life threatening situations from human or animal attack to temporarily disable the attacker to allow a user to escape to safety. A defensive unit with pressurized fluid of a chemical that can be aimed and deployed against a menacing animal or human to cause discomfort and temporarily blind or disable the attacker to allow the exerciser to escape to safety.

U.S. Pat. No. 5,557,555 discloses a dumbbell with a flashlight, pepper spray, and weights but has no disclosure of a dumbbell with an alarm and a grip exerciser. U.S. Pat. No. 5,476,192 discloses a handweight with a spray device and an alarm but there is no disclosure of a flashlight or a grip exerciser. U.S. Pat. No. 5,549,220 discloses a device with a flashlight, siren, and sprayer but there is no disclosure of a grip exerciser or a dumbbell. U.S. Pat. No. 5,243,349 discloses a dumbbell with an audible alarm and a defensive spray but fails to disclose a flashlight or a grip exerciser. U.S. Pat. Nos. 7,509,955; 5,683,168; 5,941,629; and 3,638,836 disclose a flashlight with a pepper spray canister but there is no disclosure of a dumbbell, an alarm, and grip exerciser. U.S. Pat. No. 5,795,054 discloses a flashlight in combination with either a pepper spray or a sonic alarm but not both. U.S. Pat. No. 5,556,003 discloses a hand-held device of a pepper spray canister, flashlight, and siren, but no disclosure of a dumbbell or grip exerciser. U.S. Pat. No. 5,087,032 discloses a dumbbell and a grip exerciser but does not disclose an alarm, a flashlight or a pepper spray canister. U.S. Pat. No. 5,086,377 discloses a device having an alarm, a flashlight, and a pepper spray unit, but there is no disclosure of a dumbbell or a grip unit. U.S. Pat. No. 6,132,345 discloses a dumbbell and a flashlight but there is no disclosure of a grip exerciser, pepper spray canister or an alarm.

SUMMARY OF THE INVENTION

The present invention provides an exercise device having a bar with a first handle, a grip exerciser having a second handle connected to the bar via a resistance member proximate the first handle and moveable between a first position and a second position by a hand of a user. An auxiliary device is connected to the bar and is selected from a light assembly, a sound generator, an electrified defensive unit, a pressurized defensive unit, and combinations of the same.

The present invention further provides an exercise device having a bar with a first handle, a grip exerciser having a second handle connected to the bar via a resistance member proximate the first handle and moveable between a first position and a second position by a hand of a user. An electrified defensive unit is attached to one end of the bar and a pressurized defensive unit is attached to an opposite end of the bar.

The present invention further provides an exercise device having a bar with a first handle, a grip exerciser having a second handle connected to the bar via a resistance member proximate the first handle and moveable between a first position and a second position by a hand of a user. A light assembly is attached to one end of the bar and a sound generator is attached to an opposite end of the bar.

BRIEF DESCRIPTION OF THE DRAWINGS

To understand the present invention, it will now be described by way of example, with reference to the accompanying drawings and attachments in which.

DETAILED DESCRIPTION

Figure 1:
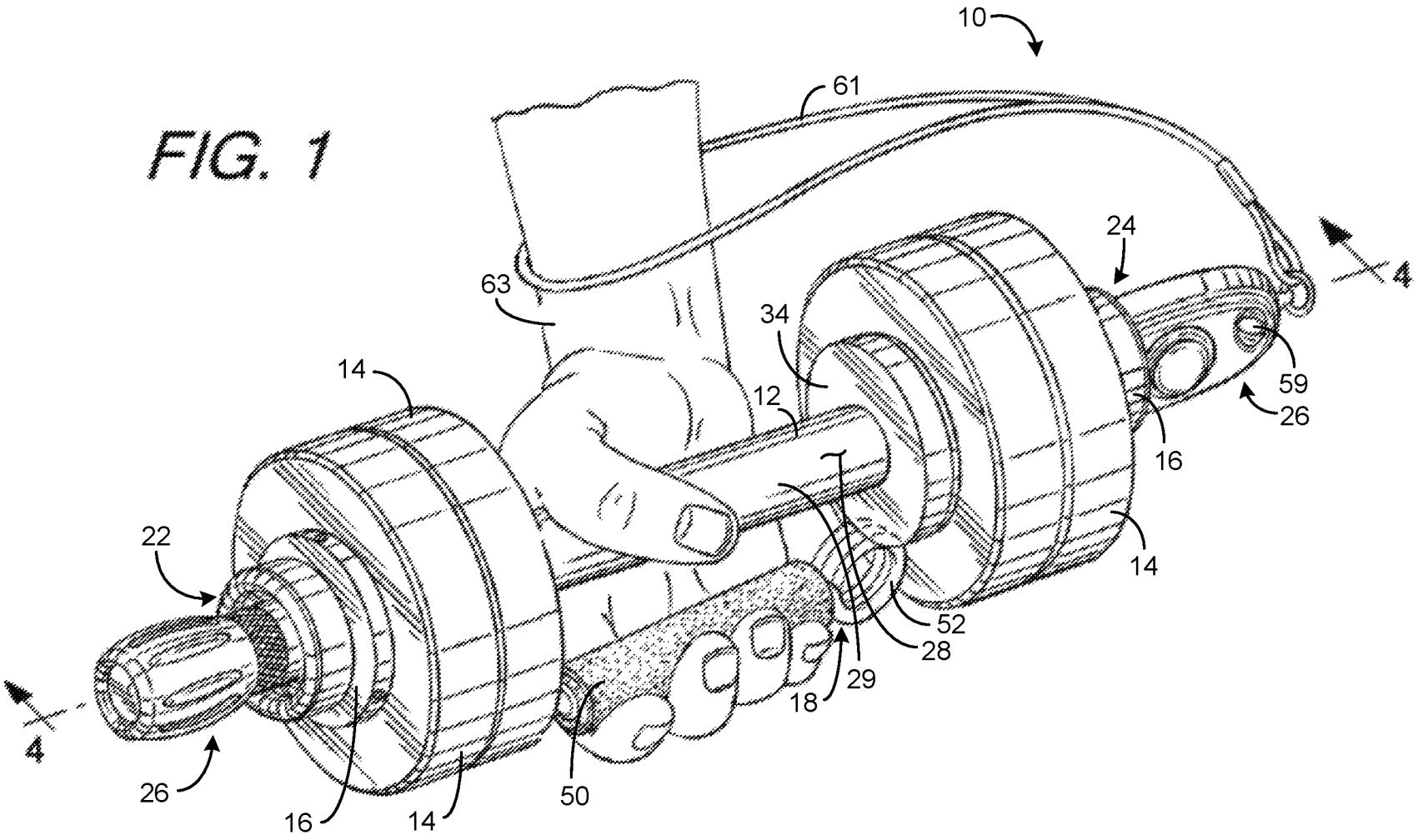
FIG. 1 is a perspective view of a dumbbell of the present invention in use by a user.
Figure 2:
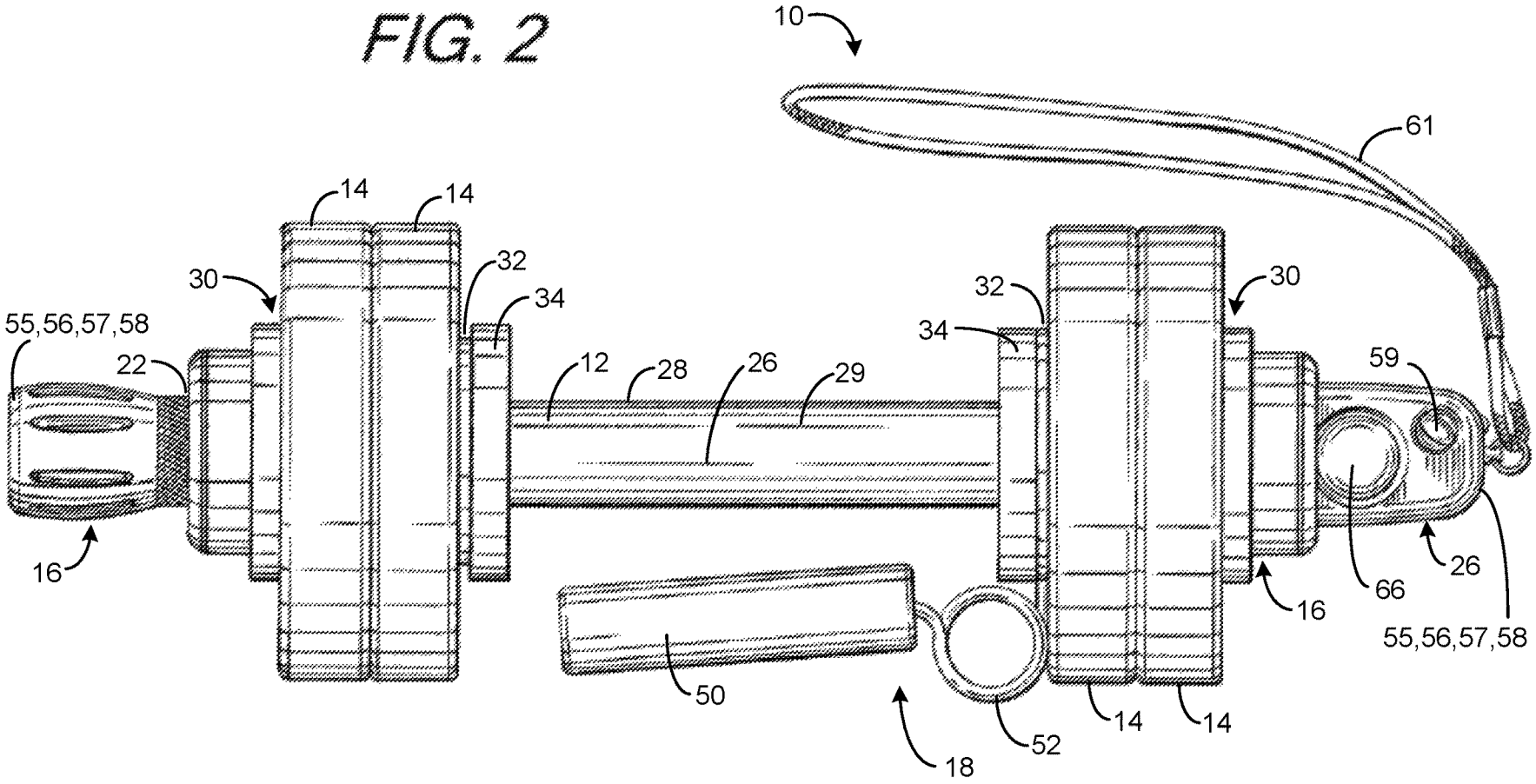
FIG. 2 is a front elevation view of a dumbbell of the present invention.
Figure 3:
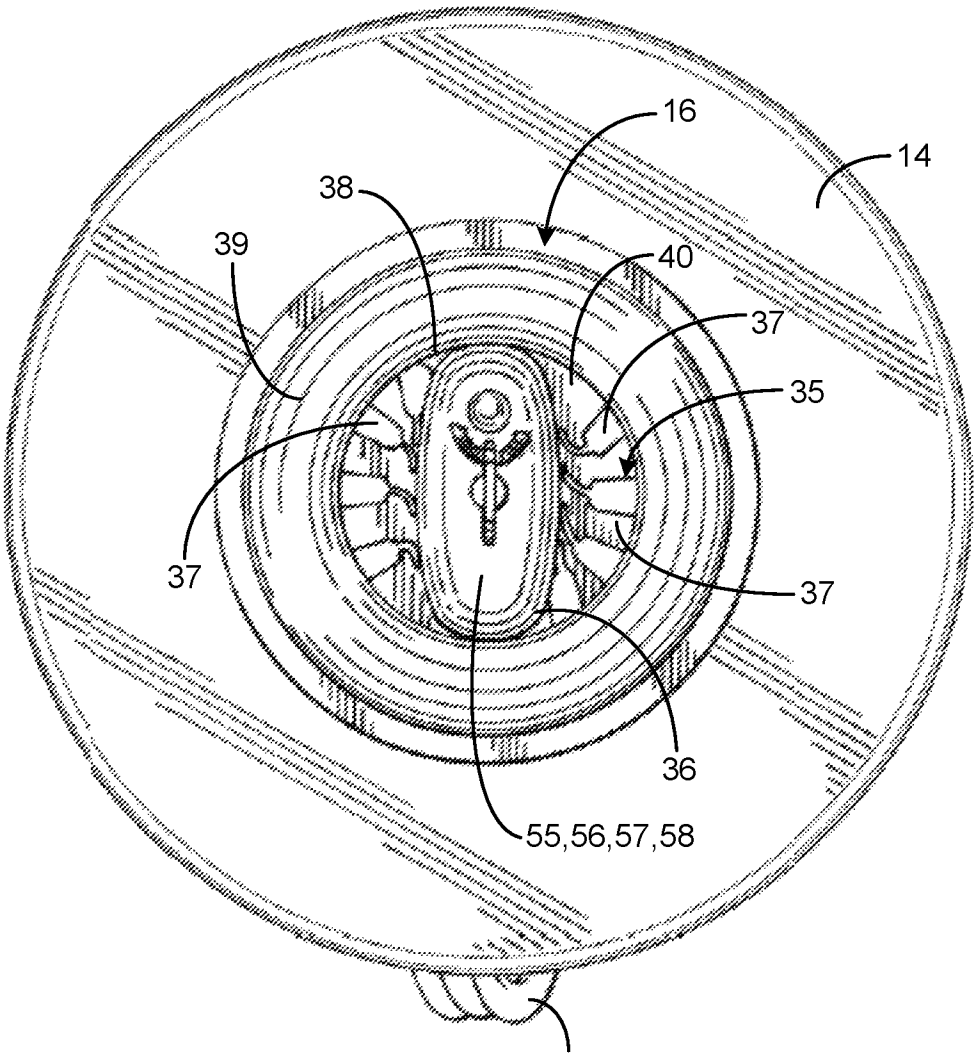
FIG. 3 is an end view of a dumbbell of the present invention.
Figure 4:
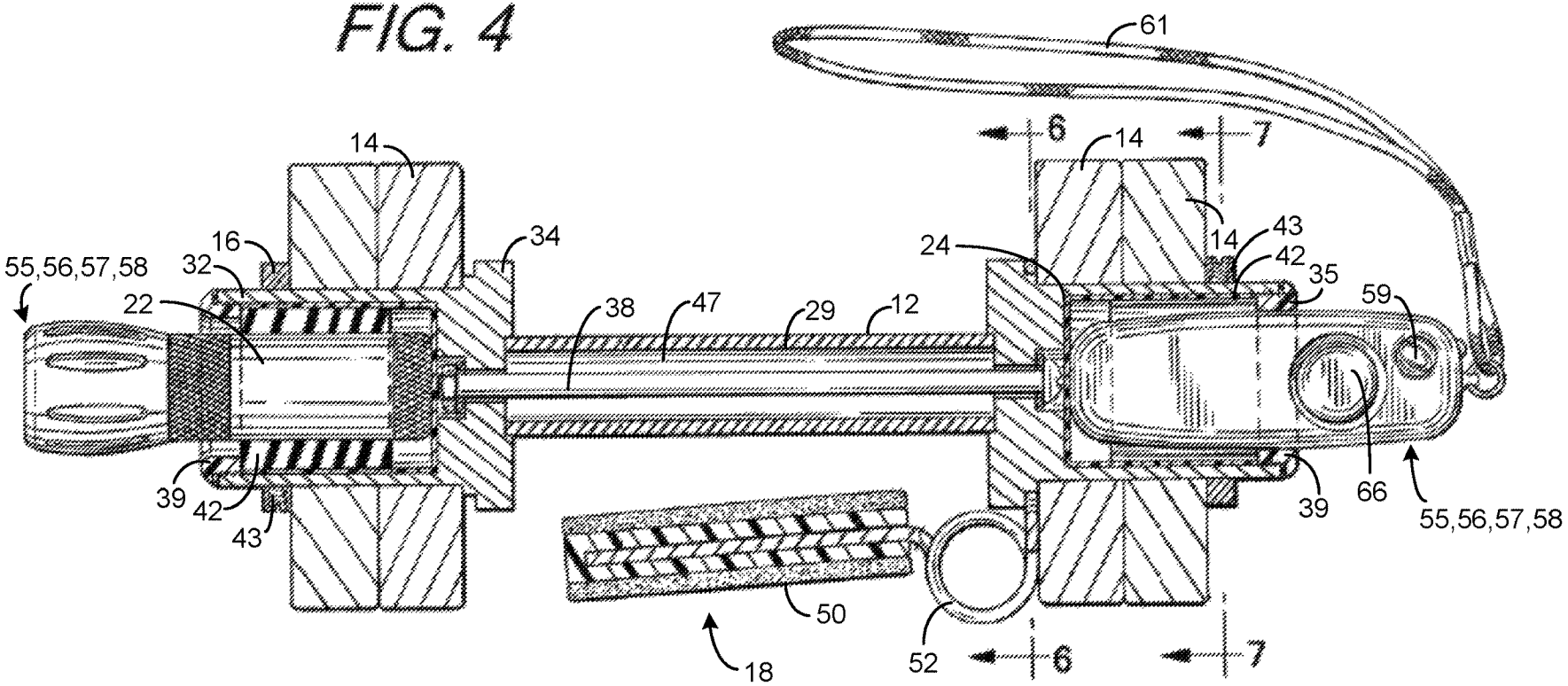
FIG. 4 is a front elevation view in cross-section taken along line 4-4 of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 shows a dumbbell safety, defensive, and alerting assembly or device 10 having an elongate cylindrical bar 12, weight plates 14, locking collars 16, a grip exerciser 18, a first end chamber 22, a second end chamber 24 opposed to the first end chamber 22, and an auxiliary device 26 positioned in both of the end chambers 22,24. The bar 12 is typically made of metal and has an axis of rotation 26, an outer diameter, an outer surface 28, a central gripping area 29, and weight receiving portions 30 on opposed ends. The bar typically weighs from 1 to 15 pounds. The outer surface 28 in the central gripping area 29 can have a surface treatment to enhance gripping such as a knurling pattern, a pattern of protuberances, a pattern of indents, embossed lines, and raised ribs to name a few.

The gripping area 29 is positioned between two cylindrical sleeves 32 mounted to the bar. The cylindrical sleeves 32 have a greater outer diameter than the bar and an outer surface of the sleeves serve as the weight receiving portions 30. A flange 34 extends from a proximal end of the sleeve 32 and serves as an inner most position for a weight plate 14. It also provides a stop surface upon which the weight plates 14 are pressed against by the locking collars 16 to secure the weights for use, as is well known in the art.

The cylindrical sleeves 32 define the end chambers 22, 24 that house the auxiliary devices 26 and include a retaining member 35, and a threaded cap 39. In one preferred form of the invention, the retaining member 35 is dimensioned to form an interference fit with an outer surface 36 of the auxiliary device 26. Preferably, the auxiliary device 26 is centrally disposed within the chamber 22,24.

In one embodiment, the retaining member 35 has a ring 41 supporting plurality of radially directed, spokes or ribs 37, circumferentially spaced from one another about an inner surface 38 of the cylindrical sleeve. The ring 41 can be disposed in an annular wall 42 to form a ring retaining assembly. The ring retaining assembly can be centrally disposed in the chamber 22,24 and held in place by the threaded cap 39. The spokes or ribs 37 can be flexible or rigid.

In another embodiment, the retaining member 35 can be a foam rubber insert, padding, dunnage, hook-and-loop fasteners, fabric or other material to fill any space between the outer surface of the auxiliary device 26 and the inner surface 38. Fasteners, brackets, clips and other retaining devices could also be used.

Figure 5:
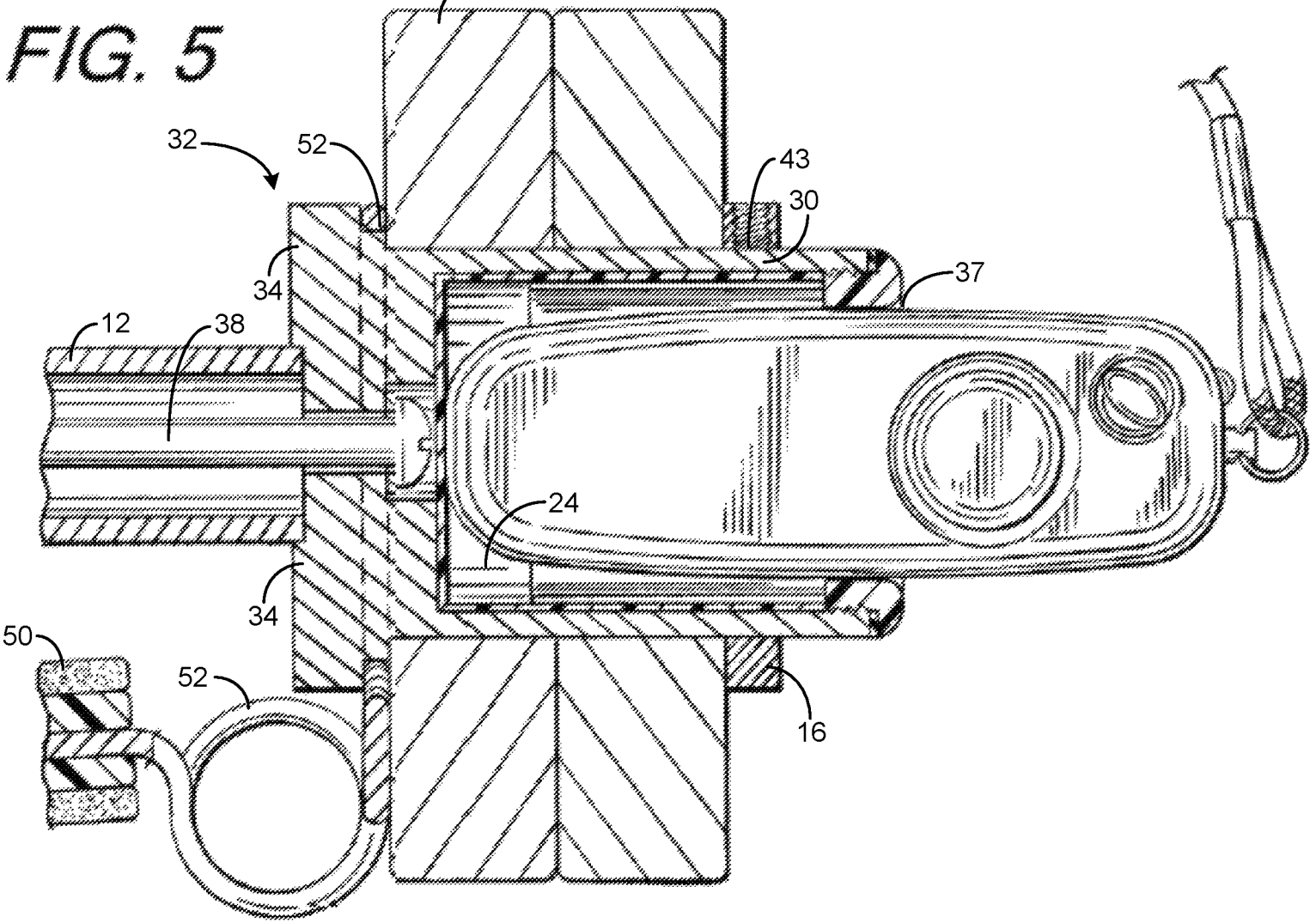
FIG. 5 is an enlarged view in cross section of a portion of the dumbbell of FIG. 1.
Figure 6:
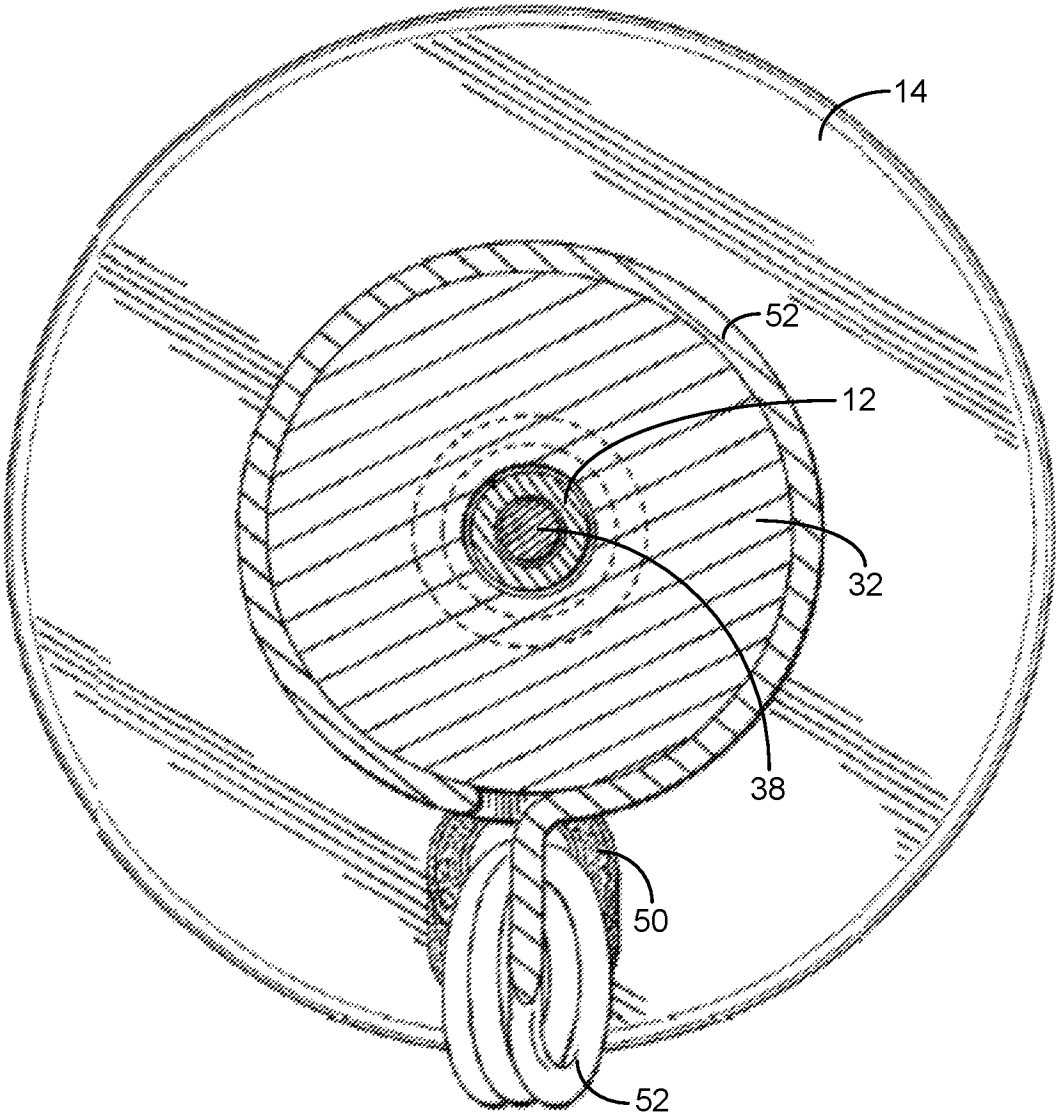
FIG. 6 is a cross sectional view taken along line 6-6 of FIG. 4.
Figure 7:
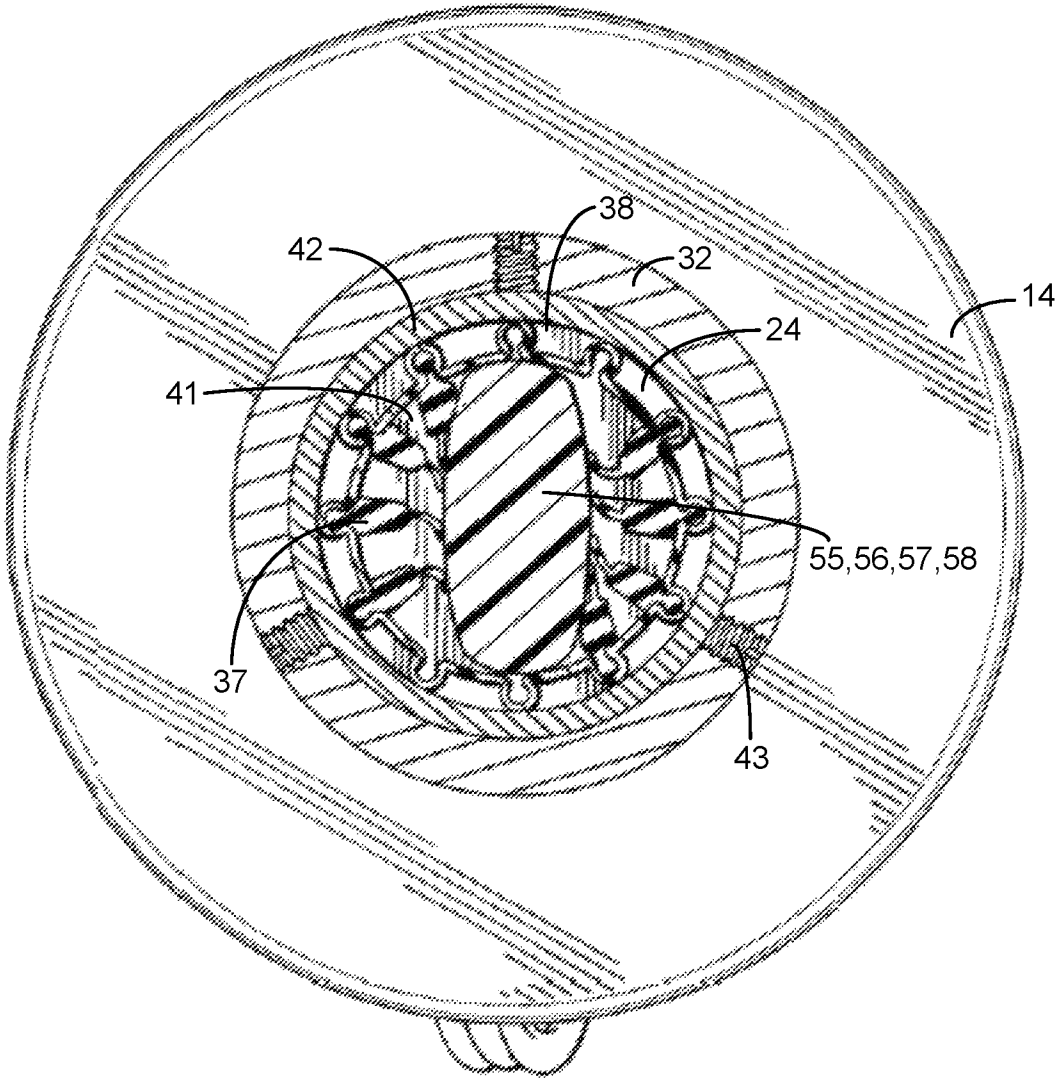
FIG. 7 is a cross sectional view taken along line 7-7 of FIG. 4.

The threaded cap 39 has a central opening 40 into the chambers 22,24. The opening 40 can be dimensioned to engage the outer surface 36 of the auxiliary device 26 to support and retain the auxiliary device 26. The cylindrical sleeves 32 can be fixedly attached to the bar or can be rotatably attached to the bar. Suitable methods of fixedly attaching include welding, brazing, soldering, by fasteners 38 (FIG. 5), and by adhesives. A bolt and nut 38 is shown as one preferred methodology for connecting the sleeves to opposed ends of the bar 12. The bar 12 is shown being generally hollow and defining an inner lumen 47 through which the bolt passes an entire length dimension of the bar 12. Suitable methods of rotatably attaching include using bearing assemblies such as ball bearings, taper bearings and the like.

Weight plates 14 are positioned in the weight receiving portions 30 and are held in place by the locking collars 16 and set screws 43. Each of the weight plates 14 has a central hole through the thickness of the plate and is dimensioned to be larger than the outer diameter of the sleeves to allow for sliding engagement with the bar 12. The difference in diameters should be small so that the weight plates 14 do not move radially causing them to rattle or vibrate against the sleeves 32 and the bar 12 and each other.

The locking collars 16 can also be of a coiled spring type connector or a clip type collar that can be releasably attached to the bar. It is also contemplated that the locking collars 16 are permanently attached to the bar such as by welding, soldering, brazing, adhesive bonding, connecting using fasteners, or other processes well known to those of ordinary skill in the art.

The grip exerciser 18 includes a handle 50 and a resistance member 52 that connects the handle to the bar. In one form of the invention, the resistance member 52 is a spring such as a coiled spring 53, for example.

Suitable auxiliary devices 26 can include a light assembly 55, an alarm or alerting assembly 56, an electrified defense device 57, a pressurized defense device 58. The auxiliary devices 26 can be used in any combination. The light assembly 55, in one embodiment, functions as a flashlight. The light assembly can also provide light at a constant illumination or it can flash the light in repeated sequences such as a strobe light. It is also contemplated that the light assembly 55 can include numerous light sources spaced from one another and can be lit in a desired or random sequence. The light assembly can also include one light source that is operated like a flashlight with a constant illumination and a second light source that flashes. Additional light sources can be added without departing from the present invention. Suitable light sources include incandescent bulbs, halogen bulbs, fluorescent bulbs, and LEDs. More preferably the light source is powered by direct current (DC) in a voltage range of from 1.5 volts to 24 volts for example.

The alarm or alerting assembly 56 is a sound generator having a sound emitter and a second switch 59 moveable from an on position to an off position. In one example alarm assembly 56, the second switch 59 is a dead-man switch. A dead-man switch 59 has a piece of connecting material such as a lanyard, rope, string, strap 61 that connects a portion of the user, such as the user's wrist 63, to the dead-man switch 59 on the alerting assembly 56. If the dumbbell is dropped, the dead-man switch 59 is triggered and the alarm sounds. When the second switch is in the on position an audible sound is emitted from a sound emitter 66. The sound emitter is meant to draw attention using a high volume noise. The noise can take on a variety of sounds including a constant tone of a single pitch, a repeated tone with a variation in volume, a sequence of tones of various pitches, a klaxon horn, a siren, an alarm, pre-recorded spoken words requesting help, among other sounds that can be used to attract attention. Like the light assembly, the sound generator can have a housing that encloses the sound emitter and a second fitment for releasably or permanently attaching to the dumbbell in the same fashion as the light assembly.

The electrified defensive device 57 has a positive electrode, a negative electrode, a source of current, and an electrical connection connecting these parts. Suitable electrified defensive devices 57 include a stun gun, and a TASER.

The pressurized defensive device 58 has a tank containing a defensive fluid under pressure. The defensive device also has an outlet, a valve at the outlet, and a trigger connected to the valve for moving the valve from a closed position to an open position. When in the open position, defensive fluid is released under pressure through the outlet and can be aimed at a desired target. Suitable defensive fluids include pepper spray (i.e., *capsicum* spray), tear gas, combinations of pepper spray and tear gas, and other chemicals and sprays likely to cause discomfort and pain to an intended target.

Other effective chemical deterrents can be used that are well known to those of ordinary skill in the art.

Suitable batteries can include rechargeable and non-rechargeable batteries. Suitable batteries can include lead acid, alkaline, nickel cadmium, nickel metal halide, silver oxide, lithium ion, and others known to those of skill in the art. Batteries come in various sizes including AAAA, AAA, AA, B, C, D, PP3 (9V), CR123A, CR2, coin-shaped cells, camera batteries, round button cells, shaped batteries, and other sources of DC current known to those of ordinary skill in the art.

Suitable switches include any type of electrical type switch including a single pole, single throw; single pole, double throw; double pole, double throw; tactile switch; dead-man switch; momentary switch, contactless switch; safety switch; multiple position rotary switch; paddle switch, and other types of switches well known to those ordinary skill in the art. The switch can be moved from off to on in a variety of manners such as by sliding a member from one place to another, pressing a button, flipping a toggle, rotating a member, making a sound, making a gesture, for example. The switch can be part of a panel of switches for controlling other or all of the auxiliary units. The switches can also be a part of the auxiliary units.

It is also contemplated that the auxiliary units can be deployed using two separate dumbbell base units (bar 12 and grip exerciser 20). One dumbbell can be equipped with any number of auxiliary units and the second dumbbell can have any number of auxiliary units. The auxiliary units of one dumbbell can be the same or different from the second dumbbell. In one embodiment, a first dumbbell base unit 12,20 has a light assembly 55 and a sound generator 56, and the second dumbbell base unit 12,20 has an electrified defensive unit 57 and a pressurized defensive unit 58. The first dumbbell assembly is a passive defensive device and the second dumbbell is an active defensive device.

Many modifications and variations of the present invention are possible in light of the above teachings. It is, therefore, to be understood within the scope of the appended claims the invention may be protected otherwise than as specifically described.

I claim:

1. An exercise device comprising:

a bar having a first end, a second end opposed to the first end, and a handle positioned between the first end and the second end, a first weight receiving portion having a first chamber is positioned proximate the first end and a second weight receiving portion having a second chamber is positioned proximate the second end;

a first auxiliary device is releasably positioned in the first chamber by a first retaining member, the first retaining member dimensioned to form an interference fit with an outer surface of the first auxiliary device;

a second auxiliary device is releasably positioned in the second chamber by a second retaining member, the second retaining member dimensioned to form an interference fit with an outer surface of the second auxiliary device; and, the first auxiliary device and the second auxiliary device are selected from the group consisting of a light assembly, a sound generator, an electrified defensive unit, and a pressurized defensive unit.

2. The exercise device of claim 1 wherein the first retaining member comprises a generally cylindrical body having an annular wall proximate an inner surface of the first chamber and having a plurality of arms circumferentially spaced about the annular wall and extending radially inwardly.

3. The exercise device of claim 2 wherein the plurality of arms are flexible.

4. The exercise device of claim 2 wherein the plurality of arms are rigid.

5. The exercise device of claim 2 wherein the plurality of arms are equally circumferentially spaced.

6. The exercise device of claim 1 wherein the first chamber has a first diameter and the first retaining member has a central opening having a second diameter smaller than the first diameter.

7. The exercise device of claim 6 wherein the second chamber has a first diameter and the second retaining member has a central opening having a second diameter smaller than the first diameter.

8. The exercise device of claim 1 wherein the handle has an outer surface with a surface treatment to enhance gripping.

9. The exercise device of claim 8 wherein the surface treatment is selected from the group consisting of a knurling pattern, a pattern of protuberances, a pattern of indents, embossed lines, and raised ribs.

10. The exercise device of claim 1 further comprising a weight plate on the first weight receiving portion and the second weight receiving portion.

11. The exercise device of claim 1 wherein the first weight receiving portion and the second weight receiving portion comprises a cylindrical sleeve having a diameter greater than a diameter of the handle.

12. The exercise device of claim 10 further comprising a locking collar on the first weight receiving portion and the second weight receiving portion and abutting the weight plate.

13. The exercise device of claim 12 wherein the locking collar is a coiled spring type connector or a clip type collar.

14. A system for assembling an exercise device comprising:

a bar having a first end, a second end opposed to the first end, and a handle positioned between the first end and the second end, a first weight receiving portion having a first chamber positioned proximate the first end, and a second weight receiving portion having a second chamber positioned proximate the second end;

a plurality of retaining members, each of the plurality of retaining members having a generally cylindrical wall and a central opening, the generally cylindrical wall is dimensioned to be inserted into the first chamber or the second chamber and form an interference fit with an inner wall of the first chamber or the second chamber, and the central opening has an inner surface dimensioned to contact an outer surface of an auxiliary device to retain the auxiliary device in the first chamber or the second chamber; and, a plurality of auxiliary devices including at least two of a light assembly, a sound generator, an electrified defensive unit, and a pressurized defensive unit.

15. The system of claim 14 wherein the inner surface is dimensioned to releasably retain a retaining member of the plurality of retaining members.

16. The system of claim 14 further comprising a grip exerciser for attaching to the handle.

17. The system of claim 14 further comprising weight plates for attaching to the first weight receiving portion and the second weight receiving portion.

18. The system of claim 17 further comprising a locking collar for releasably retaining the weight plates on the first weight receiving portion and the second weight receiving portion.

19. The system of claim 14 wherein the handle has an outer surface with a surface treatment to enhance gripping.

20. The system of claim 19 wherein the surface treatment is selected from the group consisting of a knurling pattern, a pattern of protuberances, a pattern of indents, embossed lines, and raised ribs.

* * * * *